US005559482A

United States Patent [19]

Close et al.

[11] Patent Number: 5,559,482

[45] Date of Patent: Sep. 24, 1996

[54] DUAL SHIELDED RELAY REED PACK

[75] Inventors: Robert R. Close, Bedford; William Knauer, Portage, both of Ohio

[73] Assignee: Keithley Instruments, Inc., Cleveland, Ohio

[21] Appl. No.: 446,896

[22] Filed: May 17, 1995

[51] Int. Cl.[6] ..... H01H 1/66

[52] U.S. Cl. ..... 335/151; 335/154

[58] Field of Search ..... 335/151–4

[56] References Cited

U.S. PATENT DOCUMENTS 3,308,408 3/1967 Plice ..... 335/151

3,408,603 10/1968 Morrison ..... 335/154

*Primary Examiner*—Lincoln Donovan

*Attorney, Agent, or Firm*—Pearne, Gordon, McCoy & Granger

[57] ABSTRACT

A reed relay is provided with two shields. The shields are fabricated from copper foil and insulated from each other by polyester tape or film. One shield is connected to one lead of a switching element and the other shield is connected to another lead of a switching element. The shields are wrapped around the switching element in an overlapping manner. The dual shield configuration reduces leakage and interference to improve performance, particularly in low current applications.

13 Claims, 1 Drawing Sheet

DUAL SHIELDED RELAY REED PACK

BACKGROUND OF THE INVENTION

1. Field of the Invention

This invention relates generally to the field of low current switching and specifically to reed relay shielding.

2. Description of the Related Art

Switching applications commonly use reed relays for connecting or disconnecting selected circuits. Typically, a set of three reed-type switching elements is surrounded by and operated by a single operating coil. For example, the switching elements may be normally open so that a pair of leads associated with each element is electrically disconnected. When the coil is energized, the three elements close, thereby connecting the leads.

Reed relays are used in low current switching assemblies adapted to connect selected circuits in an equipment testing environment. Circuits of a device under test are connected to a switching matrix that includes a plurality of relay assemblies. Test equipment is also connected to the matrix such that selected circuits of the device under test are connectable to selected test equipment inputs by operation of the relays. Three circuits, two signal circuits and one ground, neutral, or shield circuit, are switched simultaneously by a single relay assembly.

In such a testing environment, a high degree of accuracy and consistency is desirable in the signals conducted through the relays to achieve accurate test results. Because the currents tend to be very low (on the order of $1\times10^{-12}$A), the signals are susceptible to interference and leakage. Insulation and shielding can reduce interference and leakage. For example, copper foil is connected to one of the switching element leads and wrapped around the elements. The foil is connected to the center, that is, "guard" lead in a three element assembly. Such an arrangement has reduced leakage, however, further improvements are desirable.

SUMMARY OF THE INVENTION

The present invention provides a relay with first and second connectable contacts. An operator connects the contacts in one of an energized or de-energized state and disconnects the contacts in the other of the energized or de-energized state. A first electrically conductive shield is electrically connected to the first contact and disposed around the contacts and insulated therefrom. A second electrically conductive shield is electrically connected to the second contact and disposed around the contacts and insulated therefrom. An insulating material is disposed between the shields.

The relay may also include two other pairs of contacts disposed adjacent the first and second contacts, said other pairs of contacts being surrounded by the shields and connectable and disconnectable by the operator. The first and second contacts are connectable in a neutral circuit. The shields are made of copper foil and the insulating material is polyester tape. The operator is a coil disposed around the contacts. The shields should overlap.

One preferred embodiment of the invention is a relay pack that includes a plurality of switching elements. A first shield surrounds the switching elements and is electrically connected to a first lead of one of the switching elements. A second shield also surrounds the switching elements and is electrically connected to a second lead of the one of the switching elements. An insulating material is disposed between the first and second shields. An operating coil is disposed adjacent the switching elements and adapted to close the switching elements in one of an energized or de-energized state and open the switching elements in the other of the energized or de-energized state. The first and second leads are connectable in a neutral circuit and the one switching element is a center switching element of three switching elements.

Also described is a relay including three pairs of first and second contacts, said pairs of contacts being connectable. First and second leads are connected to the first and second contacts, respectively. A coil surrounding the contacts connects the contacts in one of an energized or de-energized state and disconnects the contacts in the other of the energized or de-energized state. The coil is connectable to an operating circuit adapted to energize the coil. A first copper foil shield is electrically connected to the first lead of one of the pairs and surrounds the contacts. A second copper foil shield is electrically connected to the second lead of the one of the pairs. The second shield surrounds the contacts and overlaps the first shield. Polyester tape is disposed between the shields and around the shields to hold the shields in place around the contacts. The one pair of contacts is connectable in a neutral circuit.

Dual shielding or guarding according to the present invention provides a substantial improvement over prior art configurations. In particular, leakage between a single shield and unshielded leads has been reduced. Dual shields increase the distance from the signal leads to the copper shield compared to single shield designs. This increased distance increases resistance and reduces leakage. In addition, connecting the dual guards to opposite leads provides a balanced shielding effect and reduces any gap in a neutral or shielding circuit.

DESCRIPTION OF THE PREFERRED EMBODIMENTS

Figure 1:
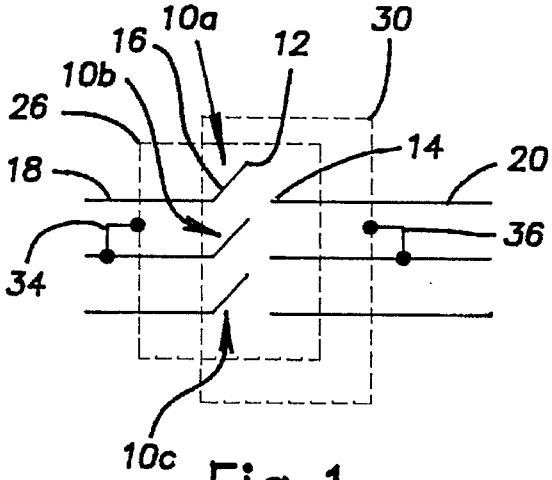
FIG. 1 shows a schematic view of switching elements and shielding according to the invention.

Referring to FIG. 1, a reed relay includes one or more switching elements 10*a*, 10*b*, and 10*c*. Each switching element 10 includes first and second contacts 12 and 14 connectable by a moveable pole or "reed" 16. The contacts 12, 14 are connected to first and second leads 18 and 20, respectively.

Figure 3:
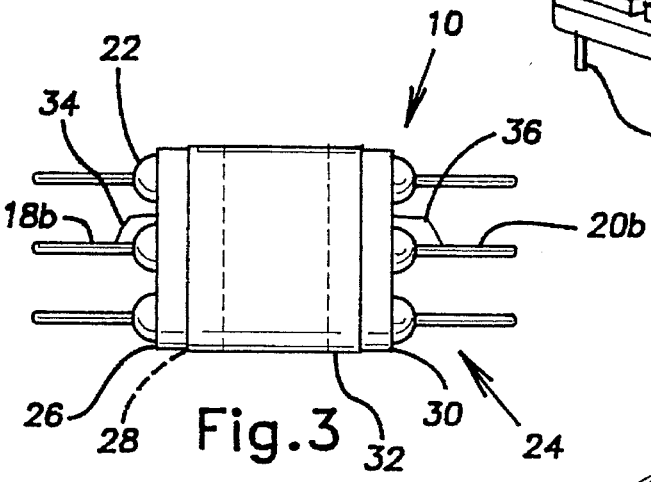
FIG. 3 shows a top view of the switching elements and shielding.
Figure 2:
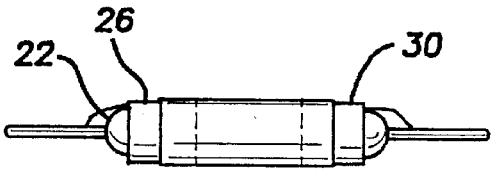
FIG. 2 shows a side view of the switching elements and shielding.

As shown in FIGS. 2 and 3, the switching elements 10 are enclosed in insulation 22 of suitable material such as glass, resin, or a polymer. Preferably, three insulated switching elements 10 are assembled into one unit or "reed pack" 24. The reed pack 24 includes a first foil shield 26 wrapped around the glass insulation 22 of the switching elements 10. The first shield is held in place by a first insulating material, such as tape 28, wrapped around the first shield 26 so as to hold the switching elements 10 together. The first insulating tape 28 insulates the first shield 26 from a second foil shield 30 wrapped around the switching elements 24. A second insulating tape 32 is wrapped around the second foil shield 30. The foil shields 26, 30 are preferably formed of copper having a thickness of about 0.01 mm. The insulating tapes 28, 32 are preferably polyester tape or film, such as Permacel® 281.

The first shield 26 is positioned toward and electrically connected to the first lead **18*b* of the center switching element 10*b* by a first jumper 34 soldered to the first shield 26 and first lead 18*b*. The second shield 30 is positioned toward and electrically connected to the second lead 20*b* of the center switching element 10*b* by a second jumper 36 soldered to the second shield 30 and second lead 20*b*. The shields 26, 30 should overlap, but each shield does not need to completely cover the switching elements 10. The first tape 28 should be positioned so as to electrically insulate the first shield 26 from the second shield 30**.

Figure 4:
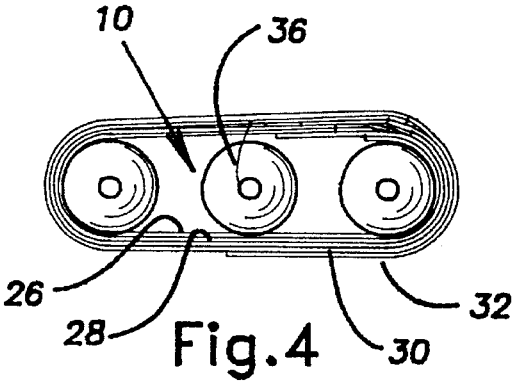
FIG. 4 shows an end view of the switching elements and shielding with thicknesses of the shielding exaggerated.

As shown in FIG. 4, each shield 26, 30 and tape 28, 32 is wrapped a little more than once around the switching elements 10. This ensures that the shields 26, 30 completely guard the switching elements 10 while maintaining minimum weight and thickness.

Figure 5:
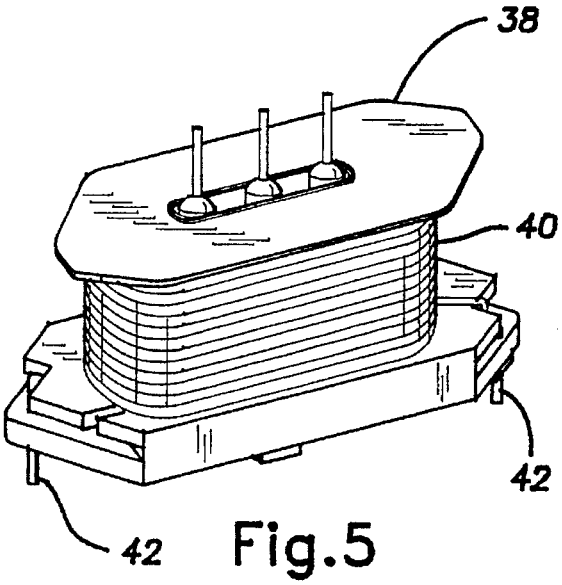
FIG. 5 shows a perspective view of a relay assembly according to the invention.

Referring to FIG. 5, the reed pack 24 is inserted in a bobbin 38. The bobbin is wound with an operator, such as an operating coil 40, connected to a pair of coil leads 42 connectable to an operating circuit. Leads 18, 20 of the switching elements 10 are connectable to circuits to be controlled or switched. When the coil 40 is energized, the reeds are moved from their normal positions to either connect (normally open) or disconnect (normally closed) the respective leads 18, 20 and the associated circuits.

The shields 26, 30 reduce current leakage, static, and interference in the switching elements 10. Connecting the shields to opposite leads provides balanced and improved shielding over single shield configurations, especially where the leads are connected to neutral or shielding conductors of the switched circuit. Improved accuracy is achieved, particularly in low current applications.

The present disclosure describes several embodiments of the invention, however, the invention is not limited to these embodiments. Other variations are contemplated to be within the spirit and scope of the invention and appended claims.

What is claimed is:

1. A relay, comprising:

first and second contacts, said contacts being connectable;

an operator that connects the contacts in one of an energized or de-energized state and disconnects the contacts in the other of the energized or de-energized state;

a first electrically conductive shield electrically connected to the first contact and disposed around the contacts and insulated therefrom;

a second electrically conductive shield electrically connected to the second contact and disposed around the contacts and insulated therefrom; and an insulating material disposed between the shields.

2. A relay according to claim 1, further comprising two pairs of contacts disposed adjacent the first and second contacts, wherein said pairs of contacts are surrounded by the shields and are connectable and disconnectable by the operator.

3. A relay according to claim 2, wherein the first and second contacts are connectable in a neutral circuit.

4. A relay according to claim 1, wherein the shields comprise copper foil.

5. A relay according to claim 1, wherein the insulating material comprises polyester tape.

6. A relay according to claim 1, wherein the operator comprises a coil disposed around the contacts.

7. A relay according to claim 1, wherein the shields overlap.

8. A relay pack, comprising:

a plurality of switching elements;

a first shield surrounding the switching elements and electrically connected to a first lead of one of the switching elements;

a second shield surrounding the switching elements and electrically connected to a second lead of the one of the switching elements;

an insulating material disposed between the first and second shields; and an operating coil disposed adjacent the switching elements and adapted to close the switching elements in one of an energized or de-energized state and open the switching elements in the other of the energized or de-energized state.

9. A relay pack according to claim 8, wherein the first and second leads are connectable in a neutral circuit.

10. A relay pack according to claim 9, wherein the one switching element is a center switching element of three switching elements.

11. A relay pack according to claim 8, wherein the shields comprise copper foil.

12. A relay, comprising:

three pairs of first and second contacts, said pairs of contacts being connectable;

first and second leads connected to the first and second contacts, respectively;

a coil surrounding the contacts that connects the contacts in one of an energized or de-energized state and disconnects the contacts in the other of the energized or de-energized state, said coil being connectable to an operating circuit adapted to energize the coil;

a first shield electrically connected to the first lead of one of the pairs, said shield comprising copper foil surrounding the contacts;

a second shield electrically connected to the second lead of the one of the pairs, said shield comprising copper foil surrounding the contacts and overlapping the first shield;

polyester tape disposed between the shields; and polyester tape disposed around the shields to hold the shields in place around the contacts.

13. A relay according to claim 12, wherein the one pair of contacts is connectable in a neutral circuit.

* * * * *